US009915073B1

(12) United States Patent
Hood

(10) Patent No.: US 9,915,073 B1
(45) Date of Patent: Mar. 13, 2018

(54) RAINSCREEN BUILDING SIDING

(71) Applicant: Andrew Hood, Chilliwack (CA)

(72) Inventor: Andrew Hood, Chilliwack (CA)

( * ) Notice: Subject to any disclaimer, the term of this patent is extended or adjusted under 35 U.S.C. 154(b) by 0 days.

(21) Appl. No.: 15/376,356

(22) Filed: Dec. 12, 2016

(51) Int. Cl.

| | |
|---|---|
| ***E04F 13/08*** | (2006.01) |
| *E04F 13/10* | (2006.01) |
| *E04F 13/14* | (2006.01) |
| *E04F 13/18* | (2006.01) |

(52) U.S. Cl.
CPC ..... *E04F 13/0864* (2013.01); *E04F 13/10* (2013.01); *E04F 13/14* (2013.01); *E04F 13/18* (2013.01)

(58) Field of Classification Search
CPC ..... E04F 13/0864; E04F 13/0846; E04F 13/0803; E04D 12/004; E04D 1/34
See application file for complete search history.

(56) References Cited

U.S. PATENT DOCUMENTS 3,797,179 A * 3/1974 Jackson ..... E04B 7/02 52/417
4,665,675 A * 5/1987 Kelly ..... E04F 13/0864 52/302.3
4,698,942 A * 10/1987 Swartz ..... E04F 13/0864 52/547
4,712,351 A * 12/1987 Kasprzak ..... E04F 13/0864 52/547
4,731,969 A * 3/1988 Baker ..... E04D 1/16 52/519
4,982,541 A * 1/1991 Winter, IV ..... E04D 1/205 52/302.1
5,519,995 A * 5/1996 Sasse ..... F15B 15/18 60/476
5,711,125 A * 1/1998 Schooling ..... E06B 3/74 52/211
6,195,952 B1 3/2001 Culpepper
7,003,922 B2 * 2/2006 Fifield ..... E04D 3/04 52/302.1
7,316,099 B2 * 1/2008 Faulkner ..... E04D 1/34 52/408
7,472,523 B2 1/2009 Beck
8,336,273 B2 12/2012 Enns
(Continued)

FOREIGN PATENT DOCUMENTS

| | | |
|---|---|---|
| CA | 2871377 | 5/2015 |
| WO | 2006063333 | 6/2006 |

*Primary Examiner* — Brian E Glessner
*Assistant Examiner* — Daniel J Kenny
(74) *Attorney, Agent, or Firm* — Richard D. Okimaw

(57) ABSTRACT

An apparatus and method for siding a building wherein the apparatus comprises an elongate planar member extending between first and second edges, top and bottom edges and having front and rear surfaces and at least one mounting block extending between first and second edges, top and bottom edges and having a rear surface wherein the at least one mounting block extends from the rear surface of the elongate planar member proximate to the top edge of the elongate planar member. The method comprises aligning each of the at least one mounting block of the siding panel with a stud location in a vertical wall and fastening the siding panel to the studs in the vertical wall through the at least one mounting block with a plurality of fasteners, so as to create a rainscreen gap between the elongate planar member and the vertical wall.

9 Claims, 2 Drawing Sheets

(56) References Cited

U.S. PATENT DOCUMENTS

| | | | | |
|---|---|---|---|---|
| 8,544,239 | B2 * | 10/2013 | Mora | E04D 12/00 52/478 |
| 8,677,709 | B2 | 3/2014 | DiLonardo et al. | |
| 9,010,050 | B2 | 4/2015 | Hatzinikolas | |
| 9,140,007 | B2 | 9/2015 | Beaty et al. | |
| 9,394,696 | B2 | 7/2016 | Norwood et al. | |
| 2009/0007517 | A1 | 1/2009 | Swanson | |
| 2010/0251655 | A1 * | 10/2010 | Monteer | E04F 13/0841 52/547 |
| 2015/0096247 | A1 | 4/2015 | Foster | |
| 2016/0109142 | A1 | 4/2016 | Breshears | |

* cited by examiner

RAINSCREEN BUILDING SIDING

BACKGROUND OF THE INVENTION

1. Field of Invention

The present invention relates generally to building materials, and in particular to building siding providing an integrated rainscreen.

2. Description of Related Art

Exterior walls of both residential and commercial buildings are typically constructed in layers. The inside layers of the walls support the floors, interior walls and roof, while the outside layers protect the inside of the building from the outdoors. Many buildings utilize building siding on the exterior walls to both protect the building from the weather as well as provide an aesthetic covering.

Building siding may be formed of horizontal or vertical boards, shingles or sheet materials, and may be formed using a variety of materials. To improve the ability of the siding to keep the walls dry, rainscreen construction methods are required by many current building codes. With a rainscreen, an air gap is formed between the outer siding and the moisture barrier. The most common method to create a rainscreen is to fasten furring vertically to the exterior wall, which spaces the siding apart from the wall and allows airflow therebetween. As a result, a passage is created behind the siding to allow any water that does penetrate the siding to drain out at the bottom.

One disadvantage of using furring to create a rainscreen is that it is an extra step in the building process, requiring separate materials and installation time. Another disadvantage is that the furring material is known to extend the full height of the building exterior which results in excessive material usage. The excessive material use includes a requirement for a large quantity of nails, which attach both the furring and siding (through the furring) to a building, resulting in a large number of penetrations through the vapor barrier, and thus a greater risk of water or moisture absorption into the underlying wall. Furthermore, with the use of furring, an inspection must be performed before the siding can be applied to the building to ensure that the correct furring material, size and spacing have been used for the rainscreen. This can delay construction and increase the overall building cost.

SUMMARY OF THE INVENTION

According to a first embodiment of the present invention there is disclosed an apparatus for siding a building on a vertical wall comprising an elongate planar member extending between first and second edges, top and bottom edges and having front and rear surfaces and at least one mounting block extending between first and second edges, top and bottom edges and having a rear surface wherein the at least one mounting block extends from the rear surface of the elongate planar member proximate to the top edge of the elongate planar member.

The elongate planar member may be substantially rectangular. The elongate planar member may be formed of a material selected from a group consisting of wood, cement, vinyl and composite materials.

The at least one mounting block may comprise a plurality of mounting blocks. The plurality of mounting blocks may be located at positions along the elongate planar member corresponding to stud locations in a vertical wall. The plurality of mounting blocks may be spaced apart to form a gap therebetween when mounted to the vertical wall.

The top edge of the at least one mounting block may be aligned with the top edge of the elongate planar member. The top edge of the at least one mounting block may extend above the top edge of the elongate planar member. The top edge of the at least one mounting block may be angled away from perpendicular relative to the rear surface in a direction toward the bottom surface of the at least one mounting block at an incline angle. The at least one mounting block may be co-formed with the elongate planar member.

According to a first embodiment of the present invention there is disclosed a method for providing an integrated rainscreen with building siding on a vertical wall comprising providing at least one siding panel comprising an elongate planar member extending between first and second edges, top and bottom edges and having front and rear surfaces and at least one mounting block extending between first and second edges, top and bottom edges and having a rear surface wherein the at least one mounting block extends from the rear surface of the elongate planar member proximate to the top edge of the elongate planar member. The method further comprises aligning each of the at least one mounting block of the siding panel with a stud location in a vertical wall and fastening the siding panel to the studs in the vertical wall through the at least one mounting block with a plurality of fasteners, so as to create a rainscreen gap between the elongate planar member and the vertical wall.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
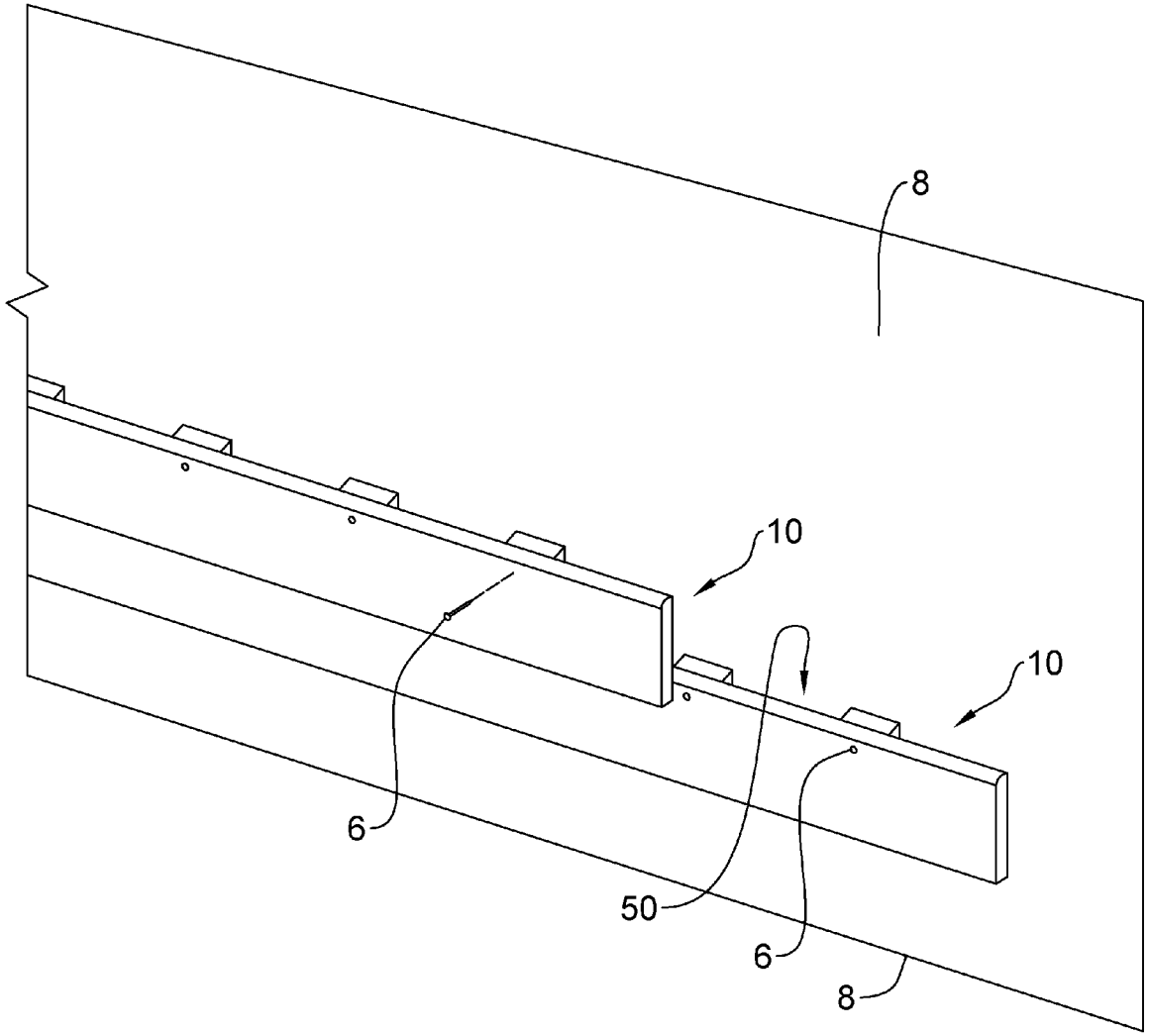
FIG. 1 is a perspective view of a plurality of siding panels according to a first embodiment of the invention, attached to an exterior wall of a building.

Referring to FIG. 1, a plurality of siding panels with an integrated rainscreen system according to a first embodiment of the invention are shown generally at 10. The siding panels 10 are mounted on an exterior wall 8 with a plurality of fasteners 6.

Figure 2:
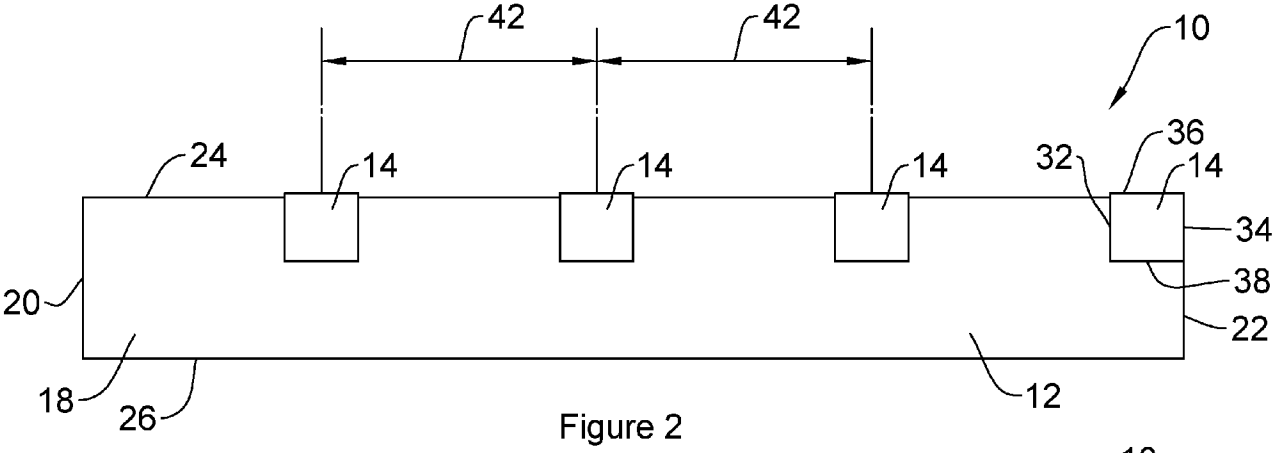
FIG. 2 is a rear view of the siding panel of FIG. 1.
Figure 4:
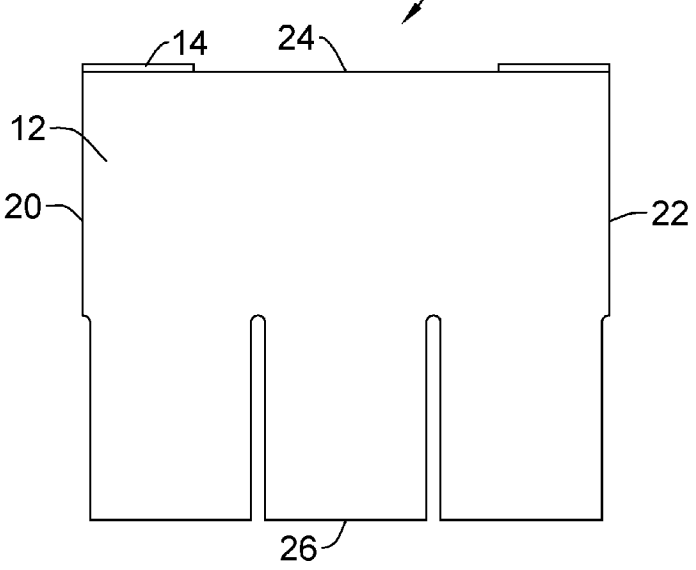
FIG. 4 is a plan view of the siding panel of FIG. 1 according to a further embodiment of the invention.
Figure 3:
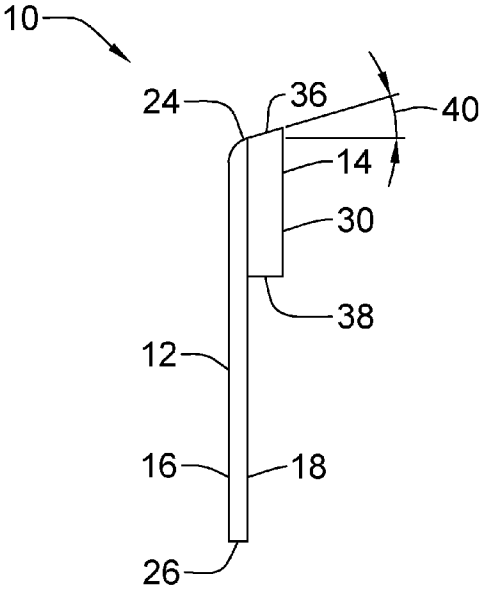
FIG. 3 is a side view of the siding panel of FIG. 1.

Each siding panel 10 comprises an elongate planar member 12 with a plurality of mounting blocks 14 thereon, as illustrated in FIGS. 2 and 3. The planar member 12, having front and rear surfaces, 16 and 18, respectively, extends between first and second edges, 20 and 22, respectively, and between top and bottom edges, 24 and 26, respectively. The planar member 12 may be substantially rectangular in shape, as illustrated in FIG. 2, although it will be appreciated that aesthetic edging details may be included, as well, such as illustrated in FIG. 4 with a plurality of decorative notches, by non-limiting example. The planar member 12 may be formed of any desired rigid material, such as, by way of non-limiting example, wood, cement, vinyl or composite materials.

The plurality of mounting blocks 14, having rear surface 30 extend between first and second edges, 32 and 34, respectively, and between top and bottom edges, 36 and 38, respectively. The top edge 36 may be formed at a slope angle 40, as illustrated in FIG. 3, to promote water drainage. The slope angle 40 may be in the range of 0-20 degrees. The thickness of the mounting blocks 14 between the rear surface 18 of the planar member 12 and the rear surface 30 of the mounting block 14 may be in the range of ⅜ inch to ½ inch (10 mm to 13 mm).

Each mounting block 14 extends from the rear surface 18 of the planar member 12 proximate to the top edge 24 such that the top edges 24 and 36 are substantially aligned, with one mounting block 14 positioned such that the second edges 22 and 34 are aligned, and additional mounting blocks 14 spaced therealong the top edge 24 of the planar member 12 at a centre spacing distance 42 to correspond with stud spacing within a vertical wall such as by way of non-limiting example in the range of 8 inches to 16 inches (203 mm to 406 mm). Although the top edges 24 and 36 may be aligned as illustrated in the present embodiment of the invention, it will be appreciated that the top edge 36 may extend above the top edge 24 of the planar member 12, which may be useful for positioning guidance during installation, as will be explained in further detail below. The plurality of mounting blocks 14 may be fastened to the planar member 12 by any known means, such as by way of non-limiting example with an adhesive. It will be appreciated that the planar member 12 and the mounting blocks 14 may also be co-formed.

To install the siding panels 10 on a wall 8, as illustrated in FIG. 1, a siding panel 10 is spaced apart from the bottom 4 of the wall 8 a desired distance, then fastened to the wall 8 with fasteners 6. The fasteners 6 may be screws or nails, as is commonly known in the art. A gap 50 is formed between the wall 8 and the rear surface 18 of the planar member 12, with the gap 50 size defined by the thickness of the mounting blocks 14, as set out above. The gap 50 forms the rainscreen, as is commonly known, without the need for additional furring. A plurality of siding panels 10 may be aligned horizontally such that the first and second edges, 20 and 22, engage upon each other with the top edges 24 aligned. Subsequent levels of siding panels 10 may be added to the wall 8 vertically above the first set of siding panels 10, as illustrated in FIG. 1.

In a further embodiment of the invention, the top edge 36 of each mounting block 14 extends above the top edge 24 of the planar member 12 such that the bottom edge 38 of each mounting block 14 engages upon the top edge 36 of the mounting block 14 on the siding panel 10 installed on the wall therebelow. This ensures that the siding panels 10 are installed at a standard distance thereapart on the wall 8.

While specific embodiments of the invention have been described and illustrated, such embodiments should be considered illustrative of the invention only and not as limiting the invention as construed in accordance with the accompanying claims.

What is claimed is:

1. A panel for siding a building on a vertical wall comprising:

an elongate planar siding member extending between first and second edges, top and bottom edges and having front and rear surfaces, wherein a horizontal length between said first and second edges is substantially greater than a vertical height between said top and bottom edges; and at least three mounting blocks extending between first and second edges, top and bottom edges and having a rear surface;

wherein said at least-three mounting blocks extend from said rear surface of said elongate planar member proximate to said top edge of said elongate planar member, wherein each of said top edge of said at least three mounting blocks and said top edge of said planar siding member are angled away from perpendicular relative to said rear surface of said planar member in a direction toward said bottom surface of said at least one mounting block at an declining angle, and wherein said planar siding member and said at least three mounting blocks are adapted to pass a fastener through a front surface of said planar siding panel and said mounting block to secure the apparatus to a wall.

2. The panel of claim 1 wherein said elongate planar member is substantially rectangular.

3. The panel of claim 1 wherein said elongate planar member is formed of a material selected from a group consisting of wood, cement, vinyl and composite materials.

4. The panel of claim 1 wherein said at least three mounting blocks are located at positions along said elongate planar member corresponding to stud locations in a vertical wall.

5. The panel of claim 1 wherein said at least three mounting blocks are spaced apart to form a gap therebetween.

6. The panel of claim 1 wherein said top edge of said at least three mounting blocks are aligned with said top edge of said elongate planar member.

7. The panel of claim 1 wherein a portion of said at least three mounting blocks extend above said top edge of said elongate planar member.

8. The panel of claim 1 wherein said at least three mounting blocks are co-formed with said elongate planar member.

9. A method for providing an integrated rainscreen with building siding on a vertical wall comprising:

providing at least one siding panel comprising:

an elongate planar siding member extending between first and second edges, top and bottom edges and having front and rear surfaces, wherein a horizontal length between said first and second edges is substantially greater than a vertical height between said top and bottom edges; and at least three mounting blocks extending between first and second edges, top and bottom edges and having a rear surface;

wherein said at least-three mounting blocks extend from said rear surface of said elongate planar member proximate to said top edge of said elongate planar member;

wherein each of said top edge of said at least three mounting blocks and said top edge of said planar siding member are angled away from perpendicular relative to said rear surface of said planar member in a direction toward said bottom surface of said at least one mounting block at an declining angle, and aligning each of said at least three mounting blocks of said siding panel with a stud location in the vertical wall; and fastening said siding panel to said studs in said vertical wall through said at least three mounting blocks with a plurality of fasteners passed through a front surface of said siding member and said at least three mounting blocks, so as to create a rainscreen gap between said elongate planar member and said vertical wall.

* * * * *